US007198710B2

(12) United States Patent
Miller et al.

(10) Patent No.: US 7,198,710 B2
(45) **Date of Patent: *Apr. 3, 2007**

(54) ISOMERIZATION/DEHAZING PROCESS FOR BASE OILS FROM FISCHER-TROPSCH WAX

(75) Inventors: Stephen J. Miller, San Francisco, CA (US); John M. Rosenbaum, Richmond, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 182 days.

This patent is subject to a terminal disclaimer.

(21) Appl. No.: 10/383,612

(22) Filed: Mar. 10, 2003

(65) Prior Publication Data

US 2004/0181110 A1 Sep. 16, 2004

(51) Int. Cl.
*C10G 67/02* (2006.01)
*C10G 73/02* (2006.01)

(52) U.S. Cl. ..... 208/78; 208/80; 208/950; 208/27

(58) Field of Classification Search ..... 208/78, 208/80, 950, 27
See application file for complete search history.

(56) References Cited

U.S. PATENT DOCUMENTS 3,852,207 A 12/1974 Stangeland
3,904,513 A 9/1975 Fischer
4,157,294 A 6/1979 Iwao
4,347,121 A 8/1982 Mayer et al.
4,401,556 A 8/1983 Bezman et al.
4,810,357 A 3/1989 Chester et al.
4,820,402 A 4/1989 Partridge et al.
4,822,476 A 4/1989 Ziemer et al.
4,913,799 A 4/1990 Gortsema et al.

(Continued)

FOREIGN PATENT DOCUMENTS

EP 0161833 11/1985

(Continued)

OTHER PUBLICATIONS

Zakarian, J.A., et al., "All-Hydroprocessing Route for High-Viscosity Index Lubes, Energy Progress", 7(1);59 (1987).

(Continued)

*Primary Examiner*—Thuan Dinh Dang
(74) *Attorney, Agent, or Firm*—Buchanan, Ingersoll & Rooney PC

(57) ABSTRACT

A method for producing lubricant base oils is provided comprising the steps of: (a) separating a feedstock into a light lubricant base oil fraction and a heavy fraction; (b) hydroisomerizing the fractions over a medium pore size molecular sieve catalyst under hydroisomerization conditions to produce an isomerized light lubricant base oil fraction having a pour point less than or equal to a target pour point of the lubricant base oils and an isomerized heavy fraction having a pour point of equal to or greater than the target pour point of the lubricant base oils and a cloud point greater than the target cloud point of the lubricant base oils; and (c) dehazing the isomerized heavy fraction to provide a heavy lubricant base oil having a pour point less than or equal to the target pour point of the lubricant base oils and a cloud point less than or equal to the target cloud point of the lubricant base oils.

36 Claims, 1 Drawing Sheet

U.S. PATENT DOCUMENTS

| | | | | | |
|---|---|---|---|---|---|
| 4,943,672 | A | * | 7/1990 | Hamner et al. | 585/737 |
| 4,975,177 | A | | 12/1990 | Garwood et al. | |
| 4,992,159 | A | * | 2/1991 | Cody et al. | 208/89 |
| 5,037,528 | A | | 8/1991 | Garwood et al. | |
| 5,059,567 | A | | 10/1991 | Linsten et al. | |
| 5,073,530 | A | | 12/1991 | Bezman et al. | |
| 5,114,563 | A | | 5/1992 | Lok et al. | |
| 5,198,203 | A | | 3/1993 | Kresge et al. | |
| 5,246,689 | A | | 9/1993 | Beck et al. | |
| 5,282,958 | A | | 2/1994 | Santilli et al. | |
| 5,334,368 | A | | 8/1994 | Beck et al. | |
| 5,643,440 | A | | 7/1997 | Borghard et al. | |
| 5,833,837 | A | * | 11/1998 | Miller | 208/80 |
| 6,051,129 | A | | 4/2000 | Harris et al. | |
| 6,090,989 | A | | 7/2000 | Trewella et al. | |
| 6,204,426 | B1 | | 3/2001 | Miller et al. | |
| 6,468,417 | B1 | | 10/2002 | Biscardi et al. | |
| 6,468,418 | B1 | | 10/2002 | Biscardi et al. | |
| 6,506,297 | B1 | | 1/2003 | Wittenbrink et al. | |

FOREIGN PATENT DOCUMENTS

| | | | | |
|---|---|---|---|---|
| EP | 0321307 | A2 | | 6/1989 |
| EP | 776959 | A2 | * | 6/1997 |
| WO | 96/13563 | A1 | | 5/1996 |
| WO | 97/03750 | | | 2/1997 |
| WO | 97/21788 | A1 | | 6/1997 |
| WO | 99/41332 | A1 | | 8/1999 |
| WO | 99/41335 | A1 | | 8/1999 |
| WO | 99/41337 | A1 | | 8/1999 |
| WO | 99/45085 | A1 | | 9/1999 |
| WO | 01/57160 | | | 8/2001 |
| WO | WO 200250213 | A2 | * | 6/2002 |

OTHER PUBLICATIONS

United Kingdom Search Report dated Jul. 21, 2004.

U.S. Appl. No. 10/383,569, Miller et al., *Method for Producing a Plurality of Lubricant Base Oils from Paraffinic Feedstock*, filed Mar. 10, 2003.

* cited by examiner

FIGURE
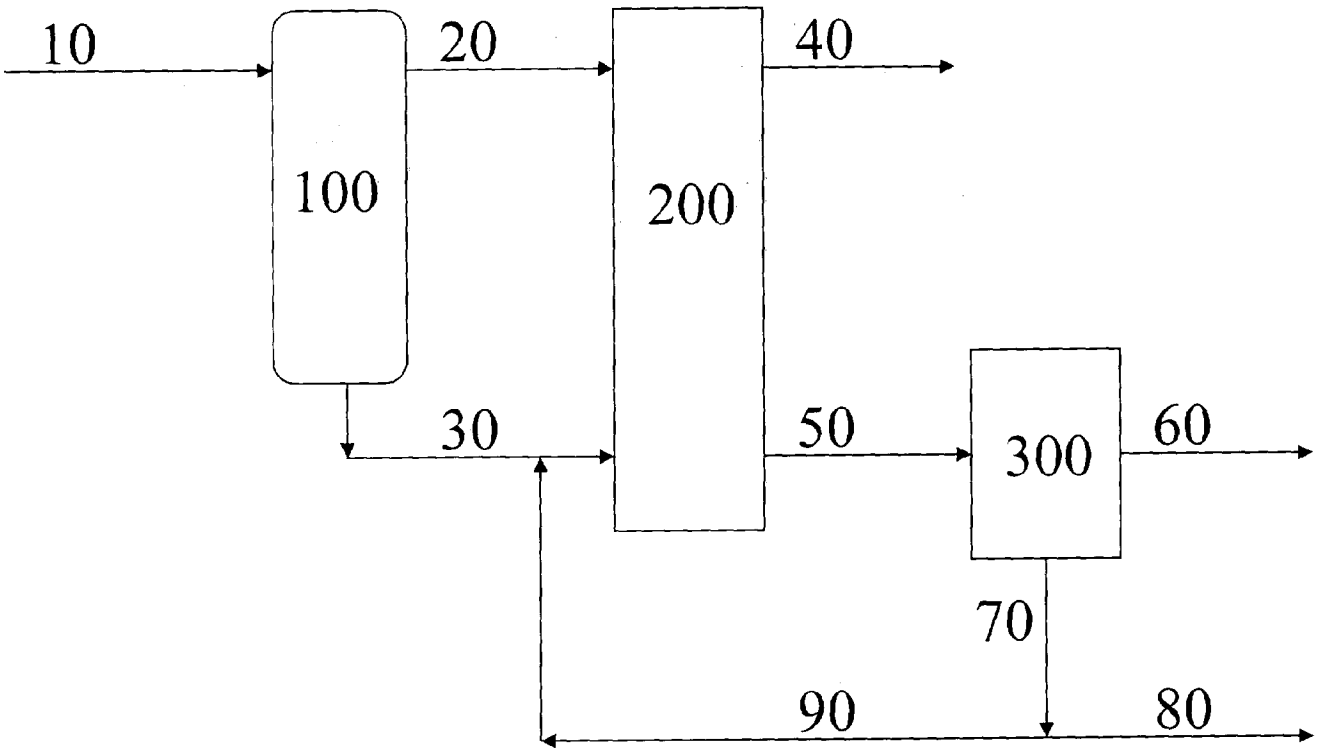

ISOMERIZATION/DEHAZING PROCESS FOR BASE OILS FROM FISCHER-TROPSCH WAX

FIELD OF THE INVENTION

The present invention relates to a process for preparing lubricant base oils from a paraffinic feedstock, such as a Fischer-Tropsch wax.

BACKGROUND OF THE INVENTION

Lubricant base oils are generally prepared by fractionating a vacuum gas oil fraction into narrow boiling range fractions, and hydrocracking and/or hydroisomerizing the narrow boiling range fractions. The fractionation is generally performed prior to the hydrocracking/hydroisomerization in an effort to increase the lubricant base oil yield and to produce the highest quality lubricant base oils.

Various processes for producing lubricant base oils are known in the art. The goal of these processes is to produce lubricant base oils with high viscosity indices and low pour points.

International Publication Number WO 96/13563 teaches a process for producing a high viscosity index lubricant having a viscosity of at least 125 from a waxy hydrocarbon feed having a wax content of at least 40 weight percent (wt. %). The disclosed process comprises catalytically dewaxing waxy paraffins present in the feed primarily by isomerization, in the presence of hydrogen and in the presence of a low acidity large pore zeolite molecular sieve having a crystal size of less than 0.1 micron, an alpha value of not more than 30 and containing a noble metal hydrogenation component. The effluent of the process may be further dewaxed by either solvent or catalytic means in order to achieve target pour point.

International Publication Number WO 99/41337 teaches a method of producing a lubricant oil feedstock from a waxy feed. Waxy feeds are treated under hydroisomerization conditions to produce an isomerate product of high viscosity index by using a silica-alumina based catalyst with a pore volume of less than 0.99 ml/gm ($H_2O$), an alumina content in the range of 35 to 55 wt. %, and an isoelectric point in the range of 4.5 to 6.5. Following isomerization the isomerate is fractionated into a lubricant cut boiling in the 330° C.+ range and a fuel cut. The lubricant fraction is then dewaxed to provide a lubricant basestock of high viscosity index.

International Publication Number WO 99/41332 teaches a method of making a wax isomerate oil having a viscosity index of from 110 to 160 and a pour point of less than −20° C. The method comprises the steps of hydrotreating a wax having a mean boiling point of from 400 to 500° C. and containing not more than 20% oil, isomerizing the hydrotreated wax over an isomerization catalyst, fractionating the resulting isomerate to recover a fraction having a viscosity in the range of about 3.0 to 5.0 cSt at 100° C. and boiling above about 340° C., and dewaxing the recovered fraction.

European Patent EP 0321307 teaches a process for the production of non-conventional lubricant oil base stocks or blending stocks of very low pour point (−21° C. or lower) and very high viscosity index (130 and higher) by the isomerization of waxes over isomerization catalysts in an isomerization unit. The total product from the isomerization unit is fractionated into a lubricant oil fraction boiling in the 330° C.+ range and a fuel cut. The lubricant oil fraction is then solvent dewaxed and unconverted wax is recycled to the isomerization unit.

International Publication Number WO 97/21788 discloses a process for the manufacture of biodegradable high performance hydrocarbon base oils. According to the process, a waxy, or paraffinic feed, particularly a Fischer-Tropsch wax, is reacted over a dual function catalyst to produce hydroisomerization and hydrocracking reactions sufficient to produce a crude fraction containing 700° F.+ isoparaffins. The methyl paraffins containing crude fraction is topped via atmospheric distillation to produce a heavy fraction having an initial boiling point between about 650 and 750° F. which is then solvent dewaxed. The dewaxed oil is then fractionated under high vacuum to produce biodegradable high performance hydrocarbon base oils.

U.S. Pat. No. 4,975,177 teaches a process of producing lubricant basestocks of high viscosity index (typically at least 130 or higher) and low pour point (typically below 5° F.) by hydroisomerizing petroleum waxes over zeolite beta and then dewaxing to target pour point. A preferred process employs a solvent dewaxing after the hydroisomerization step to effect a partial dewaxing with the separated waxes being recycled to the hydroisomerization step; dewaxing is then completed catalytically, typically over ZSM-5 or ZSM-23.

International Publication Number WO 99/41335 teaches a method for producing a lubricant basestock from a waxy feed containing 50 wt. % or more of wax. The feed is upgraded by a process comprising the steps of hydrotreating the feed to produce a material of reduced sulfur and nitrogen and hydroisomerizing the hydrotreated material over a low fluorine content, alumina based, hydroisomerization catalyst to reduce the wax content to less than about 40 wt. %. The feed is then separated into a fraction boiling below about 340° C. and a lubricant fraction boiling above about 340° C. The lubricant fraction is further processed over a catalyst comprising a mixture of a catalytically active metal component on a zeolite dewaxing catalyst and a catalytically active metal component on an amorphous catalyst. Optionally, the lubricant fraction is first solvent dewaxed before further processing.

A disadvantage of conventional processes is that they cannot effectively hydroisomerize a broad boiling range hydrocarbonaceous feedstock to produce both heavy and light lubricant base oil fractions that have acceptable pour points, viscosity indices, and yields.

When a conventional process is used to isomerize a broad boiling range feedstock to produce a high quality light lubricant base oil fraction (i.e., with an acceptable pour point and viscosity index), a relatively high pour point heavy lubricant base oil is formed. When a conventional process is used to isomerize a broad boiling range feedstock to produce a high quality heavy lubricant base oil (i.e., with an acceptable pour point and viscosity index), a relatively low viscosity index light lubricant base oil fraction is formed in relatively low yields. In order to produce both a heavy and a light lubricant base oil fraction with acceptable pour points and viscosity indices from a broad boiling range feed, the light portion is typically overdewaxed to produce heavy lubricant base oils with acceptable properties. Overdewaxing the light portion increases branching, thereby lowering the viscosity index of the light portion. The conventional solution to avoid overdewaxing a broad boiling range feedstock is to fractionate the broad boiling range feedstock into narrow boiling range fractions and then hydroisomerize each narrow boiling range fraction. This solution results in increased production cost and complexity.

It would be advantageous to provide a relatively low-cost, low-complexity process for producing a plurality of lubricant base oils with acceptable pour points, viscosity indices, and yields from a broad boiling range feedstock.

SUMMARY OF THE INVENTION

The present invention relates to processes for producing a plurality of lubricant base oils from a paraffinic feedstock. In one method according to the present invention, a paraffinic feedstock is separated into a light lubricant base oil fraction and a heavy fraction. The fractions are then hydroisomerized over a medium pore size molecular sieve catalyst under hydroisomerization conditions to produce an isomerized light lubricant base oil fraction having a pour point less than or equal to a target pour point and an isomerized heavy fraction having a pour point of equal to or greater than the target pour point and a cloud point greater than the target cloud point. Finally, the isomerized heavy fraction is dehazed to provide a heavy lubricant base oil having a pour point less than or equal to the target pour point of the lubricant base oils and a cloud point less than or equal to the target cloud point of the lubricant base oils.

In another method according to the present invention, a paraffinic feedstock is separated into a light lubricant base oil fraction and a heavy fraction which are hydroisomerized over a medium pore size molecular sieve catalyst under hydroisomerization conditions to produce isomerized light lubricant base oil and an isomerized heavy fraction. The paraffinic feedstock is derived from a Fischer-Tropsch synthesis and has an initial boiling point of less than 750° F. and an end boiling point of greater than 900° F. The isomerized light lubricant base oil fraction has a pour point less than or equal to a target pour point of the lubricant base oils and the isomerized heavy fraction has a pour point of equal to or greater than the target pour point of the lubricant base oils and a cloud point of greater than the target cloud point of the lubricant base oils. The isomerized light lubricant base oil fraction has a viscosity index of greater than 130. The isomerized heavy fraction is then dehazed to provide a heavy lubricant base oil having a pour point less than or equal to the target pour point of the lubricant base oils and a cloud point of less than or equal to the target cloud point of the lubricant base oils, the heavy lubricant base oil having a viscosity index of greater than 140.

In yet another aspect, the present invention relates to a method for treating a paraffinic feedstock. In the method, a paraffinic feedstock is separated into a light lubricant base oil fraction and a heavy fraction. The fractions are then hydroisomerized over a medium pore size molecular sieve catalyst under hydroisomerization conditions to produce an isomerized light lubricant base oil fraction having a pour point of less than −9° C., preferably in the range of −10° C. to −24° C. and an isomerized heavy fraction having a pour point of equal to or greater than −10° C. to −24° C. The isomerized heavy fraction is dehazed to provide a heavy lubricant base oil and a wax fraction wherein the heavy lubricant base oil has a pour point of less than −9° C., preferably in the range of −10° C. to −24° C. and wherein the pour point of the isomerized heavy fraction is no more than 10° C., preferably no more than 5° C. higher than that of the heavy lubricant base oil, and the cloud point of the isomerized heavy fraction is more than 10° C. higher than that of the heavy lubricant base oil.

In further embodiments the methods of the present invention may further comprise the steps of recovering wax removed from the isomerized heavy fraction during the dehazing step and repeating the first three steps, wherein at least a portion of the fractions hydroisomerized in the second step comprises the wax recovered from the dehazing step. The methods of the present invention may also comprise the step of hydrotreating the paraffinic feedstock before separation.

BRIEF DESCRIPTION OF THE DRAWING

The FIGURE illustrates a schematic representation of one embodiment of the process of the present invention.

DETAILED DESCRIPTION OF THE INVENTION

According to the present invention, a process is provided for producing a plurality of lubricant base oils from a paraffinic feedstock. The process involves separating a paraffinic feedstock into a light lubricant base oil fraction and a heavy fraction, hydroisomerizing the fractions to produce isomerized fractions, and dehazing the isomerized heavy fraction.

By using the process of the present invention, a broad boiling range paraffinic feedstock (i.e., a paraffinic feedstock having an initial boiling point of less than 750° F. and an end boiling point of greater than 900° F., and more preferably having an initial boiling point of less than 725° F. and an end boiling point of greater than 950° F., may be used to produce both a heavy lubricant base oil and a light lubricant base oil fraction having acceptable properties. Acceptable properties of light lubricant base oils include initial boiling points in the range of 600 to 750° F., and end boiling points in the range of 800 to 950° F. Light lubricant base oils generally have viscosities in the range of 3 to 8 cSt at 100° C. Target pour points for light lubricant base oils are less than −9° C., preferably in the range of −10 to −24° C. as measured by ASTM D5950-96. Acceptable properties of heavy lubricant base oils include initial boiling points in the range of 800 to 950° F., end boiling points in the range of 1050 to 1200° F., viscosities in the range of 10 to 20 cSt at 100° C., and target pour points less then 9° C., preferably in the range of −10 to −24° C. Viscosity Indexes for both light lubricant base oils and heavy lubricant base oils are in the range of 115 to 160, by ASTM D445-88. Target cloud points for lubricant base oils are in the range of 0 to −20° C. as measured by ASTM D5773-95.

Unlike the processes described in the Background section above, the process of the present invention isomerizes two lubricant base oil fractions formed in an initial fractionation and then dehazes only the isomerized heavy fraction. The present invention allows for the production of the two lubricant base oil fractions from a broad boiling paraffinic feedstock without sacrificing the quality (e.g., the pour point or the viscosity index) or the yield of either of the fractions. In other words, the present invention allows a broad boiling paraffinic feedstock to be used to produce both a heavy lubricant base oil and a light lubricant base oil fraction in higher yields and/or higher quality than when using conventional processes.

Definitions

Unless otherwise stated, the following terms used in the specification and claims have the meanings given below:

"Heavy fraction" means the heavier fraction separated from the paraffinic feedstock. The heavy fraction is subsequently hydroisomerized to produce an isomerized heavy fraction. Properties of heavy fractions include initial boiling points in the range of 800 to 950° F., end boiling points in the range of 1050 to greater than 1200° F. and viscosities in the range 10 to 20 cSt at 100° C.

"Bottoms fraction" means the heavier fraction separated by fractionation from the isomerized product as a non-vaporized (i.e. residuum) fraction.

"Isomerized heavy fraction" means the heavy fraction after having been hydroisomerized. The isomerized heavy fraction is comprised of a heavy lubricant base oil and a wax fraction. Properties of isomerized heavy fractions include wax content between 0.1 and 5 weight % (preferably 0.1 to 3 wt %), initial boiling points in the range of 800 to 950° F., end boiling points in the range of 1050 to 1200° F., viscosities in the range of 10 to 20 cSt at 100° C., viscosity indexes in the range of 115 to 160, preferably in the range of 130 to 160, and more preferably in the range of 140 to 160, pour points in the range of 0 to −20° C., and cloud points in the range of 0° C. and higher.

"Derived from a Fischer-Tropsch synthesis" means that the fuel or product in question originates from or is produced at some stage by a Fischer-Tropsch process.

"Fischer-Tropsch wax" means a product from a Fischer-Tropsch process which contains greater than 50% wax, more preferably greater than about 80% wax, most preferably greater than about 90% wax. As used herein, wax content is determined by a solvent dewaxing process. The solvent dewaxing process is a standard method, and well known in the art. In the process, 300 grams of a waxy product is diluted 50/50 by volume with a 4:1 mixture of methyl ethyl ketone and toluene which had been cooled to −20° C. The mixture is cooled at a uniform slow rate in the range of about 0.5° to 4.5° C./min) to −15° C., and then filtered through a Coors funnel at −15° C. using Whatman No. 3 filter paper. The wax is removed from the filter and placed in a tarred 2 liter flask. Solvent remaining in the wax is removed on a hot plate and the wax weighed.

"Heavy lubricant base oil" means the lubricant base oil fraction provided by dehazing of the isomerized heavy fraction. The heavy lubricant base oil is the heavier of the lubricant base oils provided by the methods of the present invention. Properties of heavy lubricant base oils include initial boiling points in the range of 800 to 950° F., end boiling points in the range of 1050 to 1200° F., viscosities in the range of 10 to 20 cSt at 100° C., viscosity indices in the range of 115 to 160, preferably in the range of 130 to 160, and more preferably in the range of 140 to 160, pour points less then −9° C., preferably in the range of −10 to −24° C., and cloud points in the range of 0 to −20° C.

"Hydrocarbonaceous" means a compound or substance that contains hydrogen and carbon atoms, but which can include heteroatoms such as oxygen, sulfur or nitrogen.

"Light lubricant base oil fraction" means the lighter fraction separated from the paraffinic feedstock. The light lubricant base oil fraction is subsequently hydroisomerized to produce an isomerized light lubricant base oil fraction. Properties of light lubricant base oil fractions include initial boiling points in the range of 600 to 750° F., end boiling points in the range of 800 to 950° F., viscosities in the range 3 to 8 cSt at 100° C., viscosity indices in the range of 115 to 160, preferably in the range of 130 to 160, and more preferably in the range of 140 to 160, pour points less then −9° C., preferably in the range of −10 to −24° C., and cloud points in the range of 0 to −20° C.

"Target pour point" means the desired pour point of the lubricant base oil products. The target pour point is less then −9° C., preferably in the range of −10° C. to −24° C., and may be −24° C. or less.

"Target cloud point" means the desired cloud point of the lubricant base oil products. The target cloud point is less than 0° C., or in the range of 0° C. to −20° C., and may be less than −20° C.

"Wax fraction" means the heavier waxy fraction provided by dehazing of the isomerized heavy fraction.

Feedstock

The feedstock to the present process is a hydrocarbonaceous paraffinic feed. The feedstock has an initial boiling point of greater than 600° F. and an end boiling point of greater than 1200° F. The feedstock preferably has an initial boiling point of less than 750° F. and an end boiling point of greater than 900° F., and more preferably has an initial boiling point of less than 725° F. and an end boiling point of greater than 950° F. The feedstock preferably has a paraffin content of greater than 70 wt. %, more preferably greater than 80 wt. %, and most preferably greater than 90 wt. %. As used herein, the term "paraffin" encompasses normal and branched paraffins, including paraffin molecules having at least one saturated ring.

The paraffinic feedstock of the present invention includes synthetic oils and waxes such as those derived from a Fischer-Tropsch synthesis (e.g., a Fischer-Tropsch wax). Suitable feeds for use in the process of the invention also include petroleum waxes, waxy distillate stocks such as gas oils, lubricating oil stocks, high pour point polyalphaolefins, foots oils, normal alpha olefin waxes, slack waxes, deoiled waxes and microcrystalline waxes Optional Hydrotreating The feedstock to the fractionation process may optionally be subjected to hydrotreating before performing the fractionation step as discussed in detail below in order to improve the quality of the feedstock. This hydrotreating process may be used to remove impurities in the feed, but it is not a hydrocracking process.

Hydrotreating is a catalytic process, usually carried out in the presence of free hydrogen, in which the primary purpose is the removal of heteroatoms (S, N, O) of the feedstock. Generally, in hydrotreating operations cracking of the hydrocarbon molecules, i.e., breaking the larger hydrocarbon molecules into smaller hydrocarbon molecules, is minimized and the unsaturated hydrocarbons are either fully or partially hydrogenated. When hydrotreating feeds derived from a Fischer-Tropsch process, hydrotreating is carried out in large part to reduce the oxygenate content of the feed, where oxygenates are primarily in the form of alcohols, but can also be in other oxygenated compounds such as ketones and aldehydes Catalysts used in carrying out hydrotreating operations are well known in the art. See for example U.S. Pat. Nos. 4,347,121 and 4,810,357, the contents of which are hereby incorporated by reference in their entirety, for general descriptions of hydrotreating, hydrocracking, and typical catalysts used in each process.

Suitable catalysts include noble metals from Group VIII (according to the 1975 rules of the International Union of Pure and Applied Chemistry), such as platinum or palladium on an alumina, silica or silica-alumina matrix, and Group VIII and Group VIB or IVA metals, such as nickel-molybdenum, cobalt-molybdenum, nickel-tungsten or nickel-tin on an alumina, silica or silica-alumina matrix. The non-noble metals are usually employed in sulfided form. U.S.

Pat. No. 3,852,207 describes a suitable noble metal catalyst and mild conditions. Other suitable catalysts are described, for example, in U.S. Pat. No. 4,157,294, and U.S. Pat. No. 3,904,513. Preferred non-noble metal catalyst compositions contain in excess of about 5 wt. %, preferably about 5 to about 40 wt. % molybdenum and/or tungsten, and at least about 0.5, and generally about 1 to about 15 wt. % of nickel and/or cobalt determined as the corresponding oxides. The noble metal (such as platinum) catalyst contains in excess of 0.01 percent metal, preferably between 0.1 and 1.0 percent metal. Combinations of noble metals may also be used, such as mixtures of platinum and palladium.

The hydrogenation components can be incorporated into the overall catalyst composition by any one of numerous procedures. The hydrogenation components can be added to matrix component by co-mulling, impregnation, or ion exchange and the Group VI components, i.e.; molybdenum and tungsten can be combined with the refractory oxide by impregnation, co-mulling or co-precipitation.

The matrix component can be of many types including some that have acidic catalytic activity. Ones that have acidic activity include amorphous silica-alumina or a zeolitic or non-zeolitic crystalline molecular sieve. Examples of suitable matrix molecular sieves include zeolite Y, zeolite X and the so called ultra stable zeolite Y and high structural silica:alumina ratio zeolite Y such as that described in U.S. Pat. No. 4,401,556, 4,820,402 and 5,059,567. Small crystal size zeolite Y, such as that described in U.S. Pat. No. 5,073,530, can also be used. Non-zeolitic molecular sieves which can be used include, for example, silicoaluminophosphates (SAPO), ferroaluminophosphate, titanium aluminophosphate and the various ELAPO molecular sieves described in U.S. Pat. No. 4,913,799 and the references cited therein. Details regarding the preparation of various non-zeolite molecular sieves can be found in U.S. Pat. No. 5,114,563 (SAPO); U.S. Pat. No. 4,913,799 and the various references cited in U.S. Pat. No. 4,913,799. Mesoporous molecular sieves can also be used, for example the M41S family of materials (J. Am. Chem. Soc., 114:10834–10843(1992)), MCM-41 (U.S. Pat. Nos. 5,246,689; 5,198,203; 5,334,368), and MCM-48 (Kresge et al., Nature 359:710 (1992)). The contents of each of the patents and publications referred to above are hereby incorporated by reference in their entirety.

Suitable matrix materials may also include synthetic or natural substances as well as inorganic materials such as clay, silica and/or metal oxides such as silica-alumina, silica-magnesia, silica-zirconia, silica-thoria, silica-berylia, silica-titania as well as ternary compositions, such as silica-alumina-thoria, silica-alumina-zirconia, silica-alumina-magnesia, and silica-magnesia zirconia. The latter may be either naturally occurring or in the form of gelatinous precipitates or gels including mixtures of silica and metal oxides. Naturally occurring clays which can be composited with the catalyst include those of the montmorillonite and kaolin families. These clays can be used in the raw state as originally mined or initially subjected to calumniation, acid treatment or chemical modification.

Typical hydrotreating conditions vary over a wide range. In general, the overall liquid hourly space velocity (LHSV) is about 0.25 to 4.0 $hr^{-1}$, preferably about 1.0 to 3.0 $hr^{-1}$. The hydrogen partial pressure is greater than 200 psia, preferably ranging from about 500 to about 2000 psia. Hydrogen re-circulation rates are typically greater than 50 SCF/Bbl, and are preferably between 1000 and 5000 SCF/Bbl. Temperatures range from about 300 to about 750° F., preferably ranging from 450 to 650° F.

Fractionation

According to the present invention, the feedstock is fractionated to produce a light lubricant base oil fraction and a heavy fraction. The fractionation can be conducted using any conventional separation process such as, for example, distillation.

Hydroisomerization

After fractionating the feedstock to produce a light lubricant base oil fraction and a heavy fraction, the fractions are hydroisomerized over a medium pore size molecular sieve catalyst to produce isomerized lubricant base oil fractions. The hydroisomerization preferably converts at least 90–95% of the wax in the fractionated feedstock. The fractions may be hydroisomerized either in the same hydroisomerization unit in "block operation" or in different hydroisomerization units. Preferably, the fractions are hydroisomerized in the same unit run in "block operation," i.e. one after the other.

The isomerized light lubricant base oil fraction has a pour point less than or equal to the target pour point of the lubricant base oils, preferably less than 9° C., more preferably in the range of −10° to −24° C., or even less than −24° C. The isomerized heavy fraction has a pour point of equal to or greater than the target pour point of the lubricant base oils and a cloud point greater than the target cloud point of the lubricant base oils. The isomerized light lubricant base oil fraction preferably has a viscosity index of greater than 130, more preferably greater than 140, and most preferably greater than 150. The catalyst and the conditions used in the hydroisomerization step may be varied to ensure that isomerized lubricant base oil fractions having desired properties (e.g., pour point, viscosity index) and/or yield are produced.

The hydroisomerization of the present invention is used to reduce the pour points of the lubricant base oil fractions by creating branches (primarily methyl branches) on normal paraffin molecules present in the lubricant base oil fractions. The extent of isomerization (i.e., the number of branches added) is related to the severity of the process. Increasing the hydroisomerization severity generally results both in increased branching and in relocation of the branches toward the center of the paraffinic chain. The pour point, the viscosity index, and the yield of an isomerized lubricant base oil fraction are all related to the extent of isomerization (and therefore to the severity of the hydroisomerization process) as follows:

(1) Increasing the number of branches decreases the pour point, with the largest effect being seen with the first branch. Each additional branch has a smaller effect on the pour point.

(2) Increasing the number of branches also relates to the yield of the desired product(s). Because hydroisomerization is not 100% selective, a percentage of the molecules of the feedstock is cracked rather than isomerized, thus resulting in molecules having lower molecular weights than the desired lubricant base oil. Increasing the severity of the hydroisomerization lowers the yield of the desired lubricant base oil.

(3) Increasing the number of branches tends to decrease the viscosity index of the product, particularly if the molecule has more than about 2–3 branches.

When determining the severity of the hydroisomerization used in the present invention, the undesirability of decreased viscosity index and decreased yield due to increased hydroisomerization severity must be balanced against the improved pour point of the product due to increased hydroisomerization severity. In particular, the conversion of the last few percent of the wax results in considerable loss of yield and VI. The severity of the hydroisomerization process may be controlled to produce an isomerized lubricant base oil fraction having the desired balance of pour point, viscosity index, and yield.

The medium pore size molecular sieve catalyst typically comprises a medium pore size crystalline molecular sieve (which is an acidic component) and a metal hydrogenation component, for example, as described in U.S. Pat. No. 5,135,638. The crystalline molecular sieve used in the present invention is of the 10- or 12-member ring variety and has a pore diameter of 4.8 to 7.1 Å across, preferably 5.3 to 6.5 Å. Specific molecular sieves which are useful in the process of the present invention include the zeolites ZSM-12, ZSM-21, ZSM-22, ZSM-23, ZSM-35, ZSM-38, ZSM-48, ZSM-57, SSZ-32, ferrierite and L and other molecular sieve materials based upon aluminum phosphates such as SM-3, SAPO-11, SAPO-31, SAPO-41, MAPO-11 and MAPO-31. The medium pore size molecular sieve is preferably SAPO-11, SM-3, SSZ-32, ZSM 22, or ZSM 23. Medium pore size molecular sieve catalysts are taught in U.S. Pat. Nos. 5,282,958, 6,204,426 and WO 99/45085.

The metal component used in the present invention comprises at least one Group VIII metal or Group VI metal, preferably a Group VIII metal. Preferably, the Group VIII metal is selected from the group consisting of at least one of platinum and palladium and optionally, other catalytically active metals such as molybdenum, nickel, vanadium, cobalt, tungsten, zinc and mixtures thereof. Most preferably, the Group VIII metal is selected from the group consisting of at least one of platinum and palladium. The amount of metal ranges from about 0.01 to about 10 wt. % of the molecular sieve, preferably from about 0.1 to about 5 wt. %, and more preferably from about 0.2 to about 1 wt. % of the molecular sieve. The techniques of introducing catalytically active metals into a molecular sieve are known, and preexisting metal incorporation techniques and treatment of molecular sieves to form an active catalyst such as ion exchange, impregnation or occlusion during sieve preparation are suitable for use in the present invention.

The term "metal" or "active metal" as used herein means one or more metals in the elemental state or in some form such as sulfide, oxide and mixtures thereof. Therefore, the Group VIII metal utilized in the process of this invention can mean one or more of the metals in its elemental state or in some form such as the sulfide or oxide and mixtures thereof. Regardless of the state in which the metal component actually exists, the concentrations are computed as if they existed in the elemental state.

The catalyst may also contain metals which reduce the number of strong acid sites on the catalyst and thereby lower the selectivity for cracking versus isomerization. Especially preferred are the Group IIA metals such as magnesium and calcium.

The hydroisomerization step of the invention may be conducted, for example, by contacting the feed with a fixed stationary bed of catalyst, with a fixed fluidized bed, or with a transport bed. A simple and therefore preferred configuration is a trickle-bed operation in which the feed is allowed to trickle through a stationary fixed bed in the presence of hydrogen.

The hydroisomerization conditions employed depend on the feedstock used and the desired balance of pour point, viscosity index, and yield in the isomerized product. Generally, the temperature is from about 200 to about 475° C., preferably from about 250 to about 450° C. The pressure is typically from about 15 to about 2500 psig (103 kPa to 27.2 MPa), preferably from about 50 to about 2000 psig (345 kPa to 13.8 MPa), more preferably from about 100 to about 1500 psig (690 kPa to 10.3 MPa). The LHSV is preferably from about 0.1 to about 20 $hr^{-1}$, more preferably from about 0.1 to about 5 $hr^{-1}$, and most preferably from about 0.1 to about 2.0 $hr^{-1}$. Low pressure and low liquid hourly space velocity provide enhanced isomerization selectivity which results in more isomerization and less cracking of the feed thus producing an increased yield.

Hydrogen is present in the reaction zone during the hydroisomerization process, typically in a hydrogen to feed ratio from about 500 to about 30,000 SCF/bbl (standard cubic feet per barrel) (76 to 4540 std liters $H_2$/kg oil), preferably from about 1,000 to about 10,000 SCF/bbl (151 to 1510 std liters $H_2$/kg oil). Generally, unreacted hydrogen will be separated from the product and recycled to the reaction zone.

Dehazing

After the fractions have been isomerized, the isomerized heavy fraction is subjected to dehazing. Dehazing is defined as a process which will not change the pour point of the feed by more than 5° C., but does change the cloud point of the feed by more than 10° C., and preferably more than 15° C. The isomerized heavy fraction is dehazed to a pour point less than or equal to the target pour point of the lubricant base oils.

Processes which remove wax from a hydrocarbon stream are useful for the dehazing step of the present invention. Such processes available in the art include solvent dewaxing, sorbent treating such as clay treating, extraction, catalytic dehazing and the like. A catalytic approach in which a catalyst selectively removes the last trace of wax with minimal degradation of the rest of the oil, is taught, for example, in U.S Pat. No. 4,822,476, the entire disclosure of which is incorporated herein by reference for all purposes. An example sorbent treating process is taught in U.S. Pat. Nos. 6,468,417 and 6,468,418, the entire disclosures of which are incorporated herein by reference for all purposes.

In a separate embodiment, dehazing may be accomplished using solving dewaxing. Hazy isomerized fractions may be solvent dewaxed in a commercial process by cooling oil-solvent admixtures under controlled conditions for crystallization of the paraffinic wax present in the admixtures. In such processes, the fractions, or mixtures of fractions and dewaxing solvent, are heated to a temperature at which the wax is dissolved. The heated charge is then passed into a cooling zone wherein cooling is undertaken at a uniform slow rate in the range of about 0.5° to 4.5° C./min until a temperature is reached (e.g. −10° to −20° C.) at which a substantial portion of the wax is crystallized and the dewaxed oil product has a selected pour point temperature. Upon achieving the desired dewaxing temperature, the mixture of wax crystals, oil and solvent is subjected to solid-liquid separation for recovery of a wax free oil-solvent solution and a solid wax containing a minor proportion of oil. The separated oil-solvent solution is subjected to distillation for recovery of a solvent fraction and a dewaxed oil product fraction.

Solvents known to be useful as dewaxing solvents are the ketones containing 3 to 6 carbon atoms, for example, acetone, methylethylketone (MEK) and methylisobutylketone (MIBK); mixtures of ketones; and mixtures of ketones with aromatic hydrocarbons including benzene and toluene. Halogenated low molecular weight hydrocarbons, including dichloromethane and dichloroethane, and their mixtures are also known dewaxing solvents. Solvent dilution of waxy oil stocks maintains fluidity of the oil for facilitating easy handling, for obtaining optimum wax-oil separation, and for obtaining optimum dewaxed oil yields. The extent of solvent dilution depends upon the particular oil stocks and solvents used, the approach to filtration temperature in the cooling zone and the desired final ratio of solvent to oil in the separation zone.

There is a small amount of wax product that may be recovered from the dehazer. As the isomerized heavy fraction preferably contains less than 5 wt. % wax initially, the dehazing generally may remove up to 5 wt. % wax from the isomerized heavy fraction. Dehazing is preferred over catalytically removing the remaining small amount of wax in the high boiling lubricant base oil fraction as dehazing results in a high boiling lubricant base oil with a higher viscosity index since the oil is not degraded by a catalytic process. Additionally, the high boiling lubricant base oil has a low cloud point which is otherwise difficult to obtain. Typically, one would not catalytically dewax the high boiling lubricant base oil fraction since there is such a small amount of wax. After being dehazed, the lheavy lubricant base oil preferably has a viscosity index of greater than 140, more preferably greater than 150.

All or a portion of the wax removed in the dehazing step may be recovered and recycled to the hydroisomerization step for use in the process of the present invention and/or collected for other uses (e.g., for processing into or use as salable wax). When recycling all or a portion of the recovered wax, the wax may be subjected to the hydroisomerization step of the present invention alone or may be combined with another paraffinic feedstock. Recycling all or a portion of the recovered wax increases the yield of the process.

Optional Hydrofinishing

One or more of the isomerized lubricant base oil fractions and the dehazed lubricant base oil fraction (or fractions) may optionally be subjected to hydrofinishing in a mild hydrogenation process to produce more stable lubrication oils. The hydrofinishing can be conventionally carried out in the presence of a metallic hydrogenation catalyst such as, for example, platinum on alumina. The hydrofinishing can be carried out at a temperature of from about 190 to about 340° C., a pressure of from about 400 to about 3000 psig (2.76 to 20.7 Mpa), a LHSV between about 0.1 and 20, and hydrogen recycle rates of about 400 to about 1500 SCF/bbl.

ILLUSTRATED EMBODIMENT

The FIGURE illustrates a schematic representation of one embodiment of the present invention. Referring to the FIGURE, a fresh paraffinic feed 10 (e.g., a Fischer-Tropsch derived feedstock) is fractionated in fractionation zone 100 into a light lubricant base oil fraction 20 and a heavy fraction 30. The light lubricant base oil fraction 20 and the heavy fraction 30 are alternately hydroisomerized under hydroisomerization conditions in hydroisomerization zone 200, which contains a medium pore size molecular sieve catalyst. The hydroisomerization zone 200 is operated such that: (1) the isomerized light lubricant base oil fraction 40 has a pour point less than or equal to the target pour point of the lubricant base oils; (2) the isomerized light lubricant base oil fraction 40 has a viscosity index of greater than 130, preferably greater than 140, more preferably greater than 150; and (3) the isomerized heavy fraction 50 has a pour point of equal to or greater than the target pour point of the lubricant base oils and a cloud point greater than the target cloud point of the lubricant base oils. The isomerized heavy fraction 50 is then dehazed in dehazing zone 300. Dehazing zone 300 is operated such that, after dehazing, the heavy lubricant base oil 60 has a pour point less than or equal to the target pour point of the lubricant base oils, a cloud point less than or equal to the target cloud point of the lubricant base oils, and a viscosity index of greater than 140, preferably greater than 150. The dehazing also produces wax fraction 70. The wax fraction 70 may be directed to a wax collection route 80 where the wax fraction 70 is collected and/or may be directed to a wax recycle route 90 where the wax is recycled and mixed with the heavy fraction 30 to be subjected to hydroisomerization zone 200.

While the invention has been described in detail and with reference to specific embodiments thereof, it will be apparent to one skilled in the art that various changes and modifications can be made without departing from the spirit and scope of the invention.

What is claimed is:

1. A method for producing lubricant base oils comprising the steps of:

(a) separating a paraffinic feedstock into a light lubricant base oil fraction and a heavy fraction;

(b) hydroisomerizing the fractions over a medium pore size molecular sieve catalyst under hydroisomerization conditions to produce an isomerized light lubricant base oil fraction having a viscosity index of greater than 130 and a pour point less than or equal to a target pour point of lubricant base oils and an isomerized heavy fraction having a pour point of equal to or greater than the target pour point of lubricant base oils and a cloud point greater than the target cloud point of the lubricant base oils; and (c) dehazing the isomerized heavy fraction to provide a heavy lubricant base oil having a viscosity index of greater than 140 and a pour point less than or equal to the target pour point of the lubricant base oils and a cloud point less than or equal to the target cloud point of the lubricant base oils.

2. The method of claim 1 wherein the target pour point is −10° C. to −24° C. and the target cloud point is 0° C. to −20° C.

3. The method of claim 1 wherein the paraffinic feedstock has an initial boiling point of less than 750° F. and an end boiling point of greater than 900° F.

4. The method of claim 1 wherein the paraffinic feedstock is derived from a Fischer-Tropsch synthesis.

5. The method of claim 4 wherein the paraffinic feedstock comprises a Fischer-Tropsch wax.

6. The method of claim 1 wherein the fractions are hydroisomerized separately in step (b) in one hydroisomerization unit at different times.

7. The method of claim 1 wherein the fractions are hydroisomerized in step (b) in different hydroisomerization units.

8. The method of claim 1 wherein the paraffinic feedstock comprises more than 90 wt. % paraffins.

9. The method of claim 1 wherein the isomerized light lubricant base oil has a viscosity index of greater than 150 and the heavy lubricant base oil has a viscosity index of greater than 150.

10. The method of claim 1 wherein the paraffinic feed stock comprises greater than 70 wt. % wax.

11. The method of claim 1 wherein the isomerized heavy fraction comprises less than 5 wt. % wax.

12. The method of claim 1 wherein the medium pore size molecular sieve catalyst comprises a molecular sieve selected from the group consisting of SAPO-11, SM-3, ZSM-22, ZSM-23, and SSZ-32.

13. The method of claim 1 further comprising the steps of:

(d) recovering wax removed from the isomerized heavy fraction during the dehazing step (c); and (e) repeating steps (a) through (c), wherein at least a portion of the fractions hydroisomerized in repeated step (b) comprises the wax recovered from the dehazing step.

14. The method of claim 1 wherein step (c) lowers the pour point of the heavy fraction by less than 10° C., and lowers the cloud point of the heavy fraction by more than 10° C.

15. The method of claim 1 wherein step (c) lowers the pour point of the heavy fraction by less than 5° C., and lowers the cloud point of the heavy fraction by more than 10° C.

16. The method of claim 15 wherein step (c) lowers the cloud point of the heavy fraction by more than 15° C.

17. The method of claim 1 further comprising the step of hydrotreating the paraffinic feedstock before separation.

18. A method for producing lubricant base oils comprising the steps of:

(a) separating a paraffinic feedstock into a light lubricant base oil fraction and a heavy fraction, the paraffinic feedstock being derived from a Fischer-Tropsch synthesis and having an initial boiling point of less than 750° F. and an end boiling point of greater than 900° F.;

(b) hydroisomerizing the fractions over a medium pore size molecular sieve catalyst under hydroisomerization conditions to produce an isomerized light lubricant base oil fraction having a pour point less than or equal to a target pour point of the lubricant base oils and an isomerized heavy fraction having a pour point of equal to or greater than the target pour point of the lubricant base oils and a cloud point greater than the target cloud point of the lubricant base oils, the isomerized light lubricant base oil fraction having a viscosity index of greater than 130; and (c) dehazing the isomerized heavy fraction to provide a heavy lubricant base oil having a pour point less than or equal to the target pour point of the lubricant base oils and a cloud point less than or equal to the target cloud point of the lubricant base oils, the heavy lubricant base oil having a viscosity index of greater than 140.

19. The method of claim 18 wherein the paraffinic feedstock comprises more than 90 wt. % paraffins.

20. The method of claim 18 wherein the isomerized light lubricant base oil fraction has a viscosity index of greater than 150 and the heavy lubricant base oil has a viscosity index of greater than 150.

21. The method of claim 18 wherein the isomerized heavy fraction contains less than 5 wt. % wax.

22. The method of claim 18 wherein the medium pore size molecular sieve catalyst comprises a molecular sieve selected from the group consisting of SAPO-11, SM-3, ZSM-22, ZSM-23, and SSZ-32.

23. The method of claim 18 further comprising the steps of:

(d) recovering wax removed from the isomerized heavy fraction during the dehazing step (c); and (e) repeating steps (a) through (c), wherein at least a portion of the fractions hydroisomerized in repeated step (b) comprises the wax recovered from the dehazing step.

24. The method of claim 18 wherein step (c) lowers the pour point of the heavy fraction by more than 5° C., and lowers the cloud point of the heavy fraction by more than 10° C.

25. A method for treating a paraffinic feedstock comprising the steps of:

(a) separating the paraffinic feedstock into a light lubricant base oil fraction and a heavy fraction;

(b) hydroisomerizing the fractions over a medium pore size molecular sieve catalyst under hydroisomerization conditions to produce an isomerized light lubricant base oil fraction having a viscosity index of greater than 130 and a pour point in the range of −10° C. to −24° C. and an isomerized heavy fraction having a pour point of equal to or greater than −10° C. to −24° C.; and (c) dehazing the isomerized heavy fraction to provide a heavy lubricant base oil and wax fraction wherein the heavy lubricant base oil has a viscosity index of greater than 140 and a pour point in the range of −10° C. to −24° C. and wherein the pour point of the heavy fraction is no more than 5° C. higher than that of the heavy lubricant fraction, and the cloud point of the heavy fraction is more than 10° C. higher than that of the heavy lubricant base oil.

26. The method of claim 25 wherein the paraffinic feedstock has an initial boiling point of less than 750° F. and an end boiling point of greater than 900° F.

27. The method of claim 25 wherein the paraffinic feedstock is derived from a Fischer-Tropsch synthesis.

28. The method of claim 27 wherein the paraffinic feedstock comprises a Fischer-Tropsch wax.

29. The method of claim 25 wherein the paraffinic feedstock comprises more than 70 wt. % paraffins.

30. The method of claim 25 wherein the paraffinic feedstock comprises more than 90 wt. % paraffins.

31. The method of claim 25 wherein the isomerized light lubricant base oil has a viscosity index of greater than 150 and the heavy lubricant base oil has a viscosity index of greater than 150.

32. The method of claim 25 wherein the isomerized heavy fraction contains less than 5 wt. % wax.

33. The method of claim 25 wherein the medium pore size molecular sieve catalyst comprises a molecular sieve selected from the group consisting of SAPO-11, SM-3, ZSM-22, ZSM-23, and SSZ-32.

34. The method of claim 25 further comprising the step of:

(d) repeating steps (a) through (c), wherein at least a portion of the fractions hydroisomerized in repeated step (b) comprises the wax fraction provided in the dehazing step.

35. The method of claim 25 wherein the cloud point of the heavy fraction is more than 15° C. higher than that of the heavy lubricant base oil.

36. The method of claim 25 further comprising the step of hydrotreating the paraffinic feedstock before separation.

* * * * *